313-414 SR
2/23/82 OR 4,317,065

United States Patent [19]
Hughes

[11] 4,317,065
[45] Feb. 23, 1982

[54] COLOR PICTURE TUBE HAVING AN IMPROVED ELECTRON GUN WITH EXPANDED LENSES

[75] Inventor: Richard H. Hughes, Lancaster, Pa.

[73] Assignee: RCA Corporation, New York, N.Y.

[21] Appl. No.: 125,648

[22] Filed: Feb. 28, 1980

[51] Int. Cl.[3] ..... H01J 29/50
[52] U.S. Cl. ..... 313/414; 313/409
[58] Field of Search ..... 313/409–414

[56] References Cited

U.S. PATENT DOCUMENTS

| | | | |
|---|---|---|---|
| 3,932,786 | 1/1976 | Campbell | 315/3 |
| 4,086,513 | 4/1978 | Evans | 313/414 |
| 4,275,332 | 6/1981 | Ashizaki et al. | 313/414 |

OTHER PUBLICATIONS

Home Furnishing Daily, Matsushita Will Use Its New Electron Gun; 9-3-79.
Ken-Ichi Doi, "Future Color TV CRTs Approach Perfection", Journal of Electronics Engineering, 11-79.
1980 IEEE Chicago Spring Conference on Consumer Electronics-"A New Approach to a High Performance Electron Gun Design for Color Picture Tubes" by K. Hosokoshi, S. Ashizaki and H. Suzuki.

*Primary Examiner*—Eli Lieberman
*Attorney, Agent, or Firm*—Eugene M. Whitacre; Glenn H. Bruestle; Dennis H. Irlbeck

[57] ABSTRACT

The present invention relates to an improvement in a color picture tube having an inline electron gun for generating and directing a plurality of electron beams, along coplanar paths toward a screen of the tube. The gun includes a main focus lens for focusing the electron beams. The improvement comprises a change in the gun electrodes that form the main focus lens. The main focus lens is formed by two spaced electrodes. Each electrode includes a member having a plurality of apertures therein equal to the number of electron beams and a lens plate spaced from the member which is electrically connected to the member. The lens plates of the two electrodes are adjacent and spaced from each other and are located between the members of the electrodes having a plurality of apertures therein. Each lens plate includes a signal large hole therein formed by a plurality of overlapping apertures equal to the number of electron beams.

4 Claims, 9 Drawing Figures

COLOR PICTURE TUBE HAVING AN IMPROVED ELECTRON GUN WITH EXPANDED LENSES

BACKGROUND OF THE INVENTION

The present invention relates to color picture tubes having improved inline electron guns, and particularly to an improvement in such guns for obtaining expanded focus lenses for reduced spherical aberration.

An inline electron gun is one designed to generate or initiate preferably three electron beams in a common plane and direct those beams along convergent paths in that plane to a point or small area of convergence near the tube screen. In one type of inline electron gun, such as that shown in U.S. Pat. No. 3,873,879, issued to R. H. Hughes on Mar. 25, 1975, in main electrostatic focusing lenses for focusing the electron beams are formed between two electrodes referred to as the first and second accelerating and focusing electrodes. These electrodes include two cup-shaped members having the bottom walls of the members facing each other. Three apertures are included in each bottom wall to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced relative to each other thereby providing a severe limitation on focus lens design. It is known in the art that the larger the focus lens diameter is, the less will be the spherical aberration which restricts the focus quality.

In addition to the focus lens diameter, the spacing between focus lens electrode surfaces is important in that greater spacing provides a more gentle voltage gradient in the lens which will also reduce spherical aberration. Unfortunately, greater spacing between electrodes beyond a particular limit (typically 1.27 mm) is not permissible because of beam bending from electrostatic charges on the neck glass penetrating into the space between the electrodes which causes electron beam misconvergence. Therefore, there is a need for further development in design of the main focusing lens electrodes which will provide improve focus lenses having reduced spherical aberration.

SUMMARY OF THE INVENTION

In an electron gun of the type described, the main focus lens is formed by two spaced electrodes. Each electrode includes a member having a plurality of apertures therein equal to the number of electron beams and a lens plate spaced from the member which is electrically connected to the member. The lens plates of the two electrodes are adjacent and spaced from each other and are located between the members of the electrodes having a plurality of apertures therein. Each lens plate includes a single large hole therein formed by a plurality of overlapping apertures equal to the number of electron beams.

DETAILED DESCRIPTION OF THE PREFERRED EMBODIMENT

Figure 1:
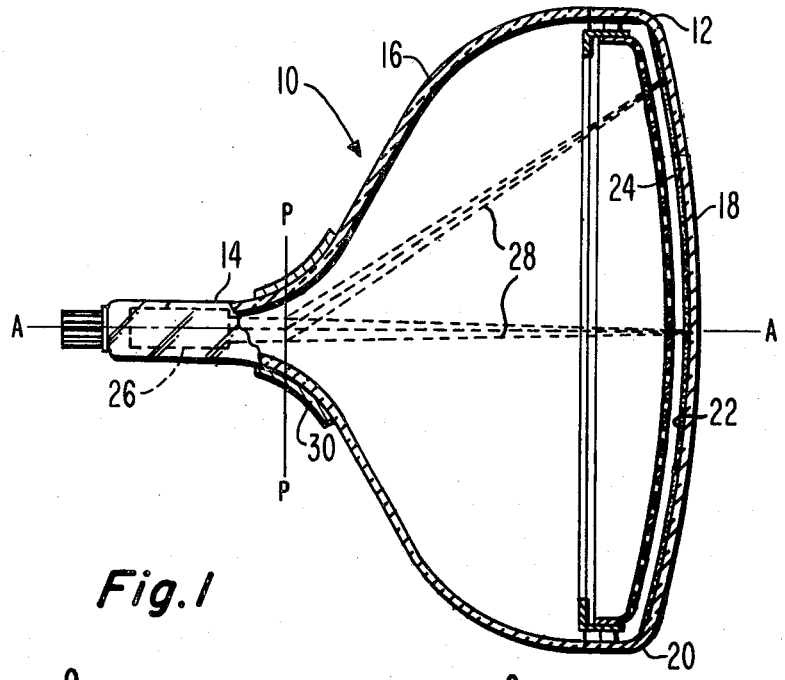
FIG. 1 is a plan view, partly in axial section of a shadow mask color picture tube in which one embodiment of the invention is incorporated.

FIG. 1 is a plan view of a rectangular color picture tube having a glass envelope 10 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction, for subjecting the three beams 28 to vertical and horizontal magnetic flux, to scan the beams horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

Figure 2:
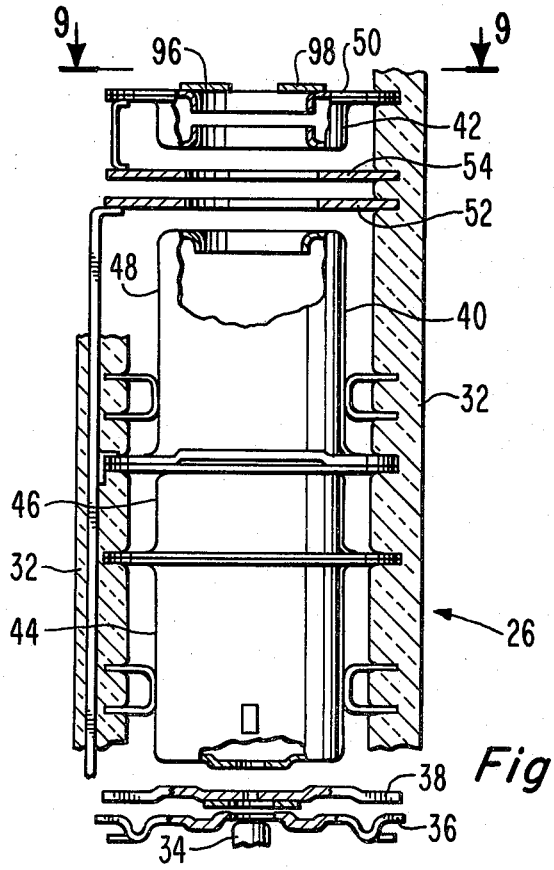
FIG. 2 is a partial axial section view of the electron gun shown in dashed lines in FIG. 1.

The details of the gun 26 are shown in FIG. 2. The gun comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the electrodes have three inline apertures in them to permit passage of three coplanar electron beams. The main electrostatic focusing lens in the gun 26 is formed between the G3 electrode 40 and the G4 electrode 42. The G3 electrode 40 is formed with three cup-shaped elements 44, 46 and 48. The open ends of two of these elements 44 and 46 are attached to each other and the open end of the third element 48 is attached to the closed end of the second element 46. The G4 electrode 42 is also cup-shaped but has its open end closed with an apertured plate 50.

Figure 3:
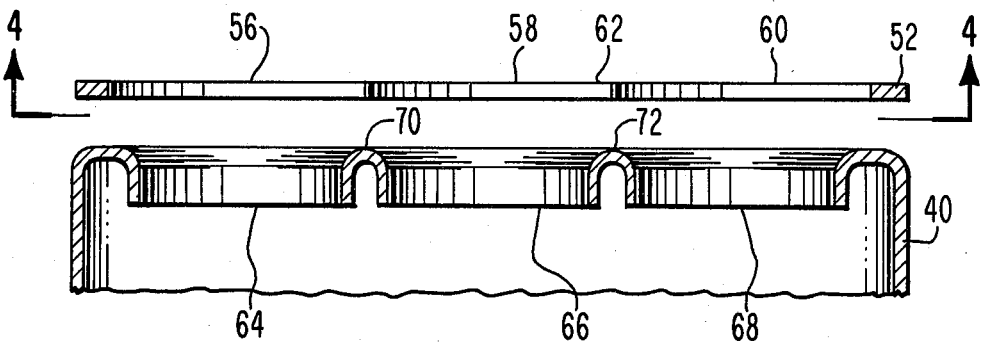
FIG. 3 is an axial sectional view of the G3 electrode of the electron gun of FIG. 2.
Figure 4:
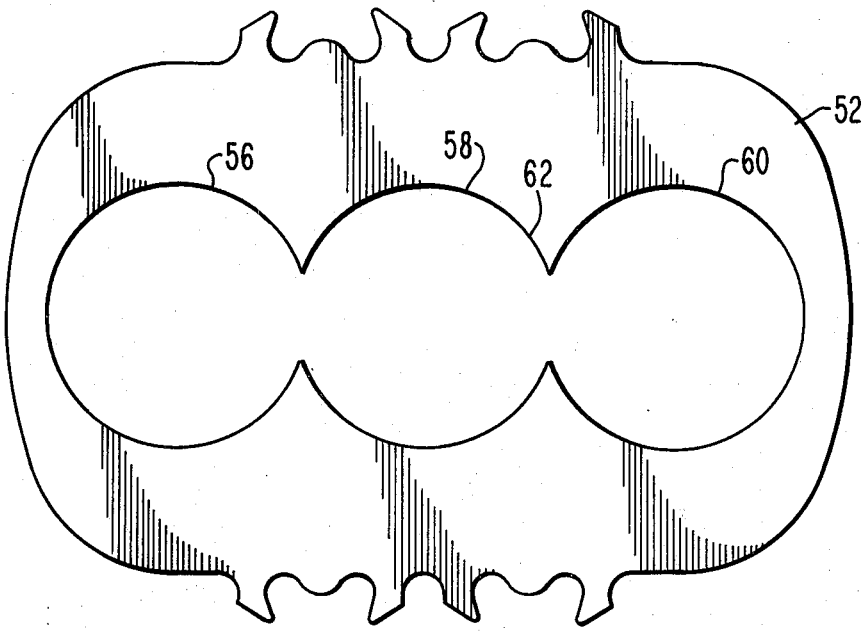
FIG. 4 is a front view of a lens plate of the electron gun of FIG. 2 taken along line 4—4 of FIG. 3.

Two substantially identical lens plates 52 and 54 are electrically connected individually to the cup-shaped portions of the electrodes 40 and 42, respectively, to form a part of these electrodes. One of these lens plates 52 is shown in greater detail in FIGS. 3 and 4. The lens plate 52 is flat and has three large circular overlapping inline apertures 56, 58 and 60 which are spaced closer than tangency to form a single continuous hole 62 without webs separating the circular apertures 56, 58 and 60. The lens plate 52 is spaced from the closed end of the G3 cup 48 a distance equal to about one-quarter the diameter of a circular hole portion 56, 58 or 60 in the lens plate 52. The G3 cup 48 has three apertures 64, 66 and 68 of smaller diameter than the apertures 56, 58 and 60 in the lens plate 52. These apertures 64, 66 and 68 are centered with the apertures 56, 58 and 60 in the lens plate 52 but because of their reduced diameter they are separated from each other by web portions 70 and 72 in the G3 cup 48. The construction of the other lens plate 54 and its relation to the G4 cup is similar to the construction of the lens plate 52 and its relation to the G3 cup 48.

Figure 6:
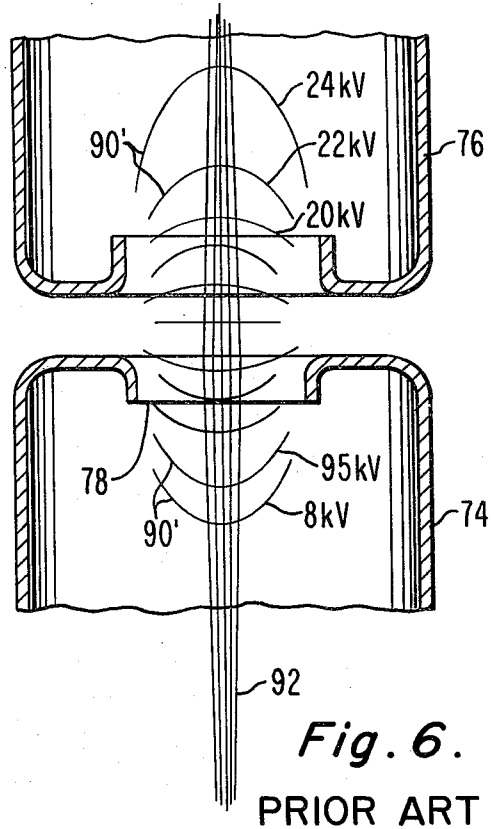
Fig. 6. PRIOR ART
FIGS. 5 and 6 are axial sectional top and side views, respectively, of the focusing lens electrodes of a prior art electron gun showing some equipotential lines of the electrostatic focusing lens fields. The view of FIG. 6 is taken at line 6—6 of FIG. 5.
Figure 5:
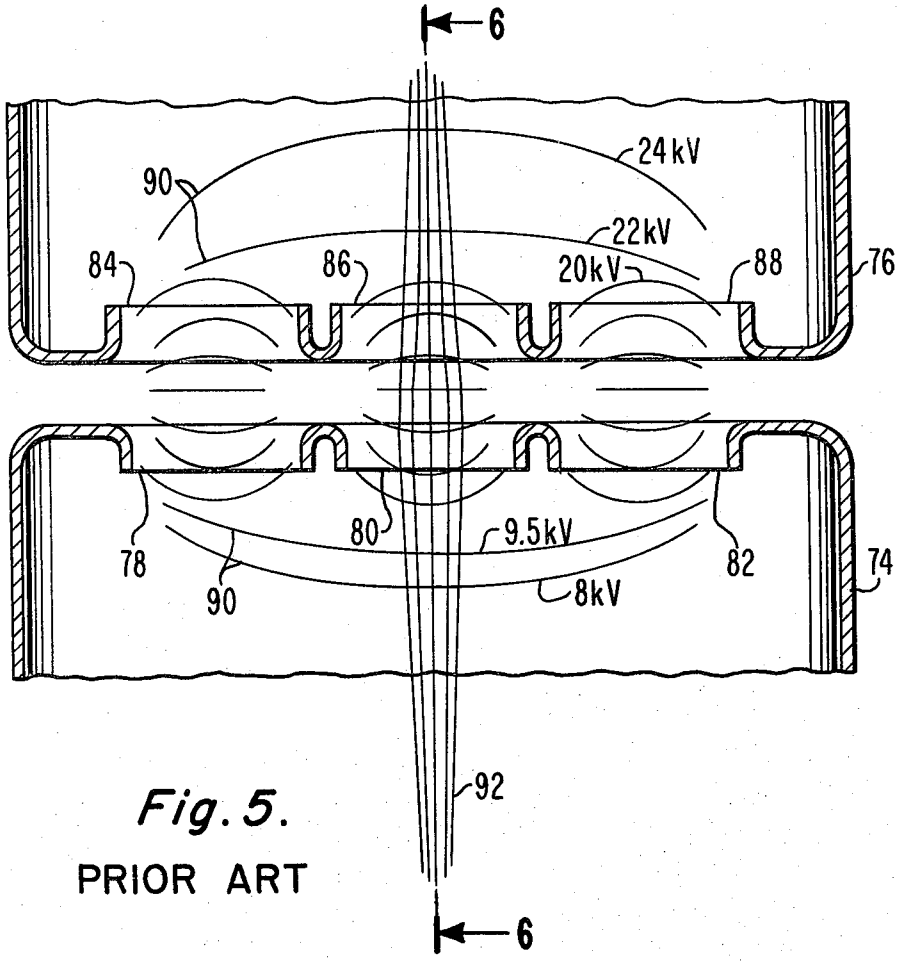
Fig. 5. PRIOR ART

FIGS. 5 and 6 show top and side sectional views, respectively, of two electrodes 74 and 76 that form the main focusing lenses of a prior art electron gun of the unitized type. The electrode 74 is the G3 electrode and the electrode 76 is the G4 electrode. The electrode 74 is cup-shaped and has three separate apertures 78, 80 and 82 in its bottom wall. Similarly, the electrode 76 also is cup-shaped and has three separate apertures 84, 86 and 88 in its bottom wall. During tube operation, a potential of 7 kV is applied to the G3 electrode 74 and a potential of 25 kV is applied to the G4 electrode 76. Because of these potentials, an electrostatic field is established in the vicinity of the G3 electrode apertures 78, 80 and 82 and the G4 electrode apertures 84, 86 and 88. The shape of the equipotential lines of this electrostatic field determines the main focusing lenses of the prior art gun. Some of these equipotential lines 90 are shown in FIGS. 5 and 6. A comparison of these equipotential lines 90 indicates that the curvature of the outer lines 90 in the top view of FIG. 5 is substantially less than the curvature of the outer lines 90' of the side view of FIG. 6. Such difference of curvature is especially noted in the equipotential lines of 8, 9.5, 22 and 24 kV. Because of this difference of curvature, referred to as astigmatism, an electron beam 92 passing through the center apertures 80 and 86 will be focused more vertically, as shown in FIG. 6, than horizontally as shown in FIG. 5. However, as can be seen in FIG. 5, the two outer electron beams will encounter greater electrostatic line curvatures than the center beam and therefore will be horizontally focused slightly more than the center beam thereby resulting in slightly less astigmatism for the outer beams.

Figure 8:
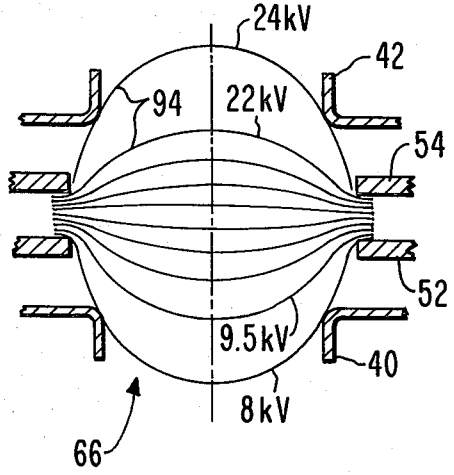
FIGS. 7 and 8 are axial sectional top and side views, respectively, of the focusing lens electrodes of the electron gun of FIG. 2 showing some equipotential lines of the electrostatic focusing lens fields. The view of FIG. 8 is taken at line 8—8 of FIG. 7.
Figure 7:
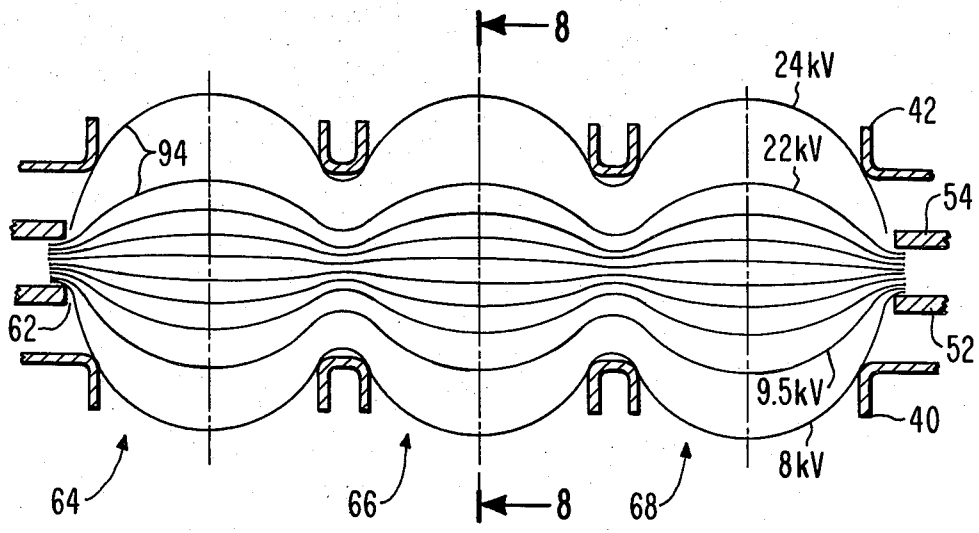

As best shown in FIGS. 7 and 8, the improved electron gun 26 of FIG. 2 provides main focusing lenses having substantially reduced spherical aberration compared to that described with respect to the prior art gun of FIGS. 5 and 6. The reduction in spherical aberration is the result of increasing the thickness of the main focus lens and of increasing the size of the main focus lens. The lens thickness is increased by spreading out the electrode components that form the main focus lens and the lens size is increased because of the large holes in the lens plates 52 and 54 formed by overlapping the three apertures in each plate. Some of the equipotential lines 94 and 94' of the main focusing field of the improved electron gun 26 are shown in the top and side views of FIGS. 7 and 8, respectively. As can be seen, the vertical curvature of the equipotential lines, shown in FIG. 8, are much more nearly like the horizontal curvature, shown in FIG. 7, than were shown in the similar views for the prior art gun. Because of this similarity of curvature, an electron beam passing through the one of the focus lenses will be focused more equally in the vertical and horizontal planes. Therefore, the type of astigmatism previously noted with respect to the prior art gun of FIGS. 5 and 6 is greatly reduced.

Generally, in the improved gun 26, the spacing between the lens plate 52 and the closest surface of the lens cup 48 of the electrode is roughlv one-quarter the diameter of the aperture portions in the lens plate. The diameter of the apertures in the lens cup 48 is such as to just touch an equipotential line within 4% of the electrnde voltage that would exist if the cup 48 were not present. In the embodiment shown, this 4% line is approximately a semicircle. Spacing of the four elements forming the main focusing lens should be close enough to exclude neck charging from bending the electron beams.

Figure 9:
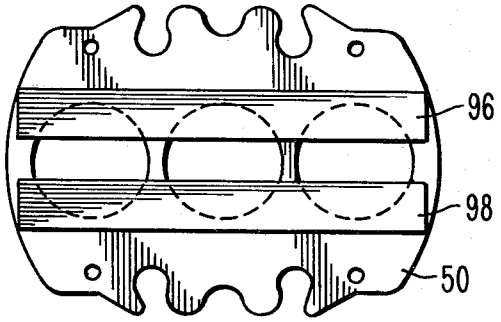
FIG. 9 is a plan view of the G4 electrode of the electron gun of FIG. 2 taken along line 9—9 of FIG. 2.

Because the lens plates 52 and 54 do not have separations between the aperture portions which form the single large holes (e.g. hole 62 in lens plate 52), there is a slot effect astigmatism formed by the main focusing lens because of penetration of the focusing field through the areas where web sections are missing. This effect can be noted by comparing the compression of the equipotential lines 94 at the sides of the FIG. 7 embodiment with the compression of the same lines at the two areas near the center of the focus lens. This field penetration causes the focus lens to have greater vertical lens strength than horizontal lens strength. A correction is made for this astigmatism in the electron gun 26 of FIG. 2 by the inclusion of a horizontal slot opening at the exit of the G4 electrode 42. The slot is optimum at one-half the lens diameter in width and is spaced at 86% of the lens diameter from the opposite surface of the G4 electrode. This slot is formed by two strips 96 and 98, shown in FIGS. 2 and 9 welded to the apertured plate 50 of the G4 electrode 42 so as to extend across the three apertures in the plate 50.

Some typical dimensions for the electron gun 26 of FIG. 2 are presented in the following table.

TABLE

| | |
|---|---|
| Internal diameter of tube neck | 29.00mm |
| Spacing between electrode cup 48 and lens plate 52 | 1.27mm |
| Spacing between cup portion of electrode 42 and lens plate 54 | 1.27mm |
| Spacing between lens plates 52 and 54 | 1.27mm |
| Thickness of lens plates 52 and 54 | 0.38mm |
| Center-to-center spacing between adjacent apertures in G3 electrode 40 | 6.60mm |
| Inner diameter of apertures 64, 66 and 68 in G3 electrode 40 | 5.44mm |
| Diameter of aperature portions 56, 58 and 60 forming hole 62 in lens plate 52 | 6.99mm |
| spacing between strips 96 and 98 | 2.79mm |
| 86% of focus lens diameter | 4.70mm |

What is claimed is:

1. In a color picture tube having an inline electron gun for generating and directing a plurality of electron beams, along coplanar paths toward a screen of said tube, said gun including a main focus lens for focusing said electron beams, the improvement comprising the main focus lens being formed by two spaced electrodes, each electrode including a member having a plurality of apertures therein equal to the number of electron beams and a lens plate spaced from said member which is electrically connected to said member, the lens plates of the two electrodes being adjacent and spaced from each other and being located between the members of the electrodes having a plurality of apertures therein, each lens plate including a single large hole therein formed by a plurality of overlapping apertures equal to the number of electron beams.

2. In a color picture tube having an inline electron gun for generating and directing three electron beams, along coplanar paths toward a screen of said tube, said gun including a main focus lens for focusing said electron beams, the improvement comprising the main focus lens being formed by two spaced electrode members each having three separate apertures therein and by two spaced lens plates positioned between and spaced from the two spaced electrode members, each lens plate being electrically connected to the electrode member closest thereto, and each lens plate including a single large hole therein formed by three overlapping apertures, the centers of the separated apertures in each electrode member being aligned with the centers of the overlapping apertures in the lens plate electrically connected thereto.

3. In a color picture tube having an inline electron gun for generating and directing a plurality of electron beams, along coplanar paths toward a screen of said tube, said electron gun having at least two electrodes which form a main electrostatic focusing lens for each electron beam, each of said focus lens electrodes including a member of unitized construction having three separated apertures therein aligned with the electron beam paths, the improvement comprising each of said focus lens electrodes including a lens plate which is electrically connected to the electrode member having three separated apertures therein, the lens plates for each electrode being located adjacent each other and between the electrode members having a plurality of separated apertures therein equal to the number of electron beams, each of said lens plates including a single large hole therein formed by a plurality of apertures equal to the number of electron beams aligned with the apertures of the electrode members having separated apertures therein, the apertures in the lens plates having diameters larger than the spacing between adjacent apertures in the lens plates thus forming the single large holes in the lens plates.

4. In a color picture tube having an inline electron gun for generating and directing three electron beams, comprising a center beam and two outer beams, along coplanar paths toward a screen of said tube, said electron gun having two electrodes which form a main electrostatic focusing lens for each electron beam, each of said focus lens electrodes including a member of unitized construction having three separated apertures therein aligned with the electron beam paths, the improvement comprising each of said focus lens electrodes including a lens plate which is electrically connected to the electrode member having three separated apertures therein, the lens plates for each electrode being located ajacent each other and between the electrode members having three separated apertures therein, each of said lens plates including a single large hole therein formed by three apertures aligned with the apertures of the electrode members having three separated apertures therein, the three apertures in the lens plates having diameters larger than the spacing between adjacent apertures in the lens plates thus forming the single large holes in the lens plates.

* * * * *